United States Patent [19]

Grunewald et al.

[11] 3,995,458

[45] Dec. 7, 1976

[54] LAUNDRY MACHINE

[75] Inventors: Heinz Grunewald, Bremen; Jurgen Wellbrock, Lilienthal, both of Germany

[73] Assignee: Engelhardt & Forster, Bremen, Germany

[22] Filed: Feb. 24, 1975

[21] Appl. No.: 552,729

[30] Foreign Application Priority Data

Dec. 10, 1974 Germany ..... 2458338

[52] U.S. Cl. ..... 68/140; 68/143; 68/210

[51] Int. Cl.[2] ..... D06F 21/04; D06F 37/08; D06F 37/30

[58] Field of Search ..... 68/13 R, 58, 140, 142, 68/143, 144, 145, 146, 148, 153, 157, 158, 210, 27

[56] References Cited

UNITED STATES PATENTS

| | | | |
|---|---|---|---|
| 2,029,126 | 1/1936 | Rybeck | 68/210 X |
| 2,056,803 | 10/1936 | Failing | 68/153 X |
| 2,337,137 | 12/1943 | Thompson et al. | 68/144 X |
| 3,210,969 | 10/1965 | Sulzmann | 68/158 X |
| 3,247,690 | 4/1966 | Kahn | 68/58 X |
| 3,336,768 | 8/1967 | Kleefisch | 68/58 |
| 3,503,230 | 3/1970 | Sulzmann | 68/58 |
| 3,546,904 | 12/1970 | Zapfel | 68/140 X |
| 3,869,883 | 3/1975 | Rotter | 68/58 |

*Primary Examiner*—Philip R. Coe

[57] ABSTRACT

The invention relates to a laundry machine comprising a washing drum which is rotatable about its longitudinal axis; the generated surface of the drum being formed with apertures through which washing liquid can flow. The drum is supported, preferably by an endless retaining element, such that an outer surface of the drum is spaced apart from an inner surface portion of a casing. At least one partition extends substantially radially inside the drum thereby dividing the drum into discrete segments. The partition has an aperture and conveyor means are disposed inside the drum for conveying laundry from one segment of the drum to an adjacent segment thereof via the aperture. A flange extends substantially radially outwardly from the drum, and from between each pair of adjacent segments thereof, thereby dividing the gap between the drum and the casing into pockets or chambers, means being provided for obtaining a fluid-tight seal between each flange and the casing. Washing liquid may be fed to each pocket or chamber between the drum and the casing via respective pipes communicating therewith.

30 Claims, 13 Drawing Figures

LAUNDRY MACHINE

BACKGROUND OF THE INVENTION

The invention relates to a continuous laundry machine, more particularly for laundering batches consisting of unbundled items, the machine having a washing drum which is disposed in a casing at a distance from the casing inner wall and which is rotatable around its longitudinal axis and whose generated surface is formed with apertures for the passage of washing liquid and through which the laundry can be moved axially, in countercurrent to the washing liquid, by means of a convey or disposed inside the drum, the gap between the same and the casing being radially subdivided into outer pockets or chambers or the like to and from which washing liquid can be supplied and removed, possibly via pipes, such pockets or chambers or the like being disposed substantially symmetrically of an inner washing chamber or pocket of teh radially subdivided drum.

The earliest models of machines of this kind had a horizontally inclined drum dipping into an open trough-like casing containing liquid at a constant level. Machines of this kind cannot provide different treatment zones each with its own washing conditions.

The casing therefore became drum-shaped and the gap between the casing and the drum was subdivided by annular ribs terminating at a distance from the drum, as disclosed for example by German Auslegeschrift No. 1,303,233. In this known washing machine the drum interior is also subdivided by annular ribs. Laundry is conveyed through the drum by means of conveying or entraining ribs and by means of a trough which has provision for limited axial movement. This known machine cannot provide complete separation between adjacent washing areas either.

To reduce this disadvantage the volume of the gap between the drum and the casing is reduced so that the most of the washing liquid is received by the drum. The result is still unsatisfactory, since optimum operation of a machine of this kind requires very precise separation and isolation between the discrete washing zones — e.g. for cold prewash, hot prewash, boiling, hot rinse and cold rinse, so far as conditions such as temperature, addition of detergent and other additives are concerned.

Nor can these requirements be met by the washing machine disclosed by German Offenlegungsschrift 1,964,414. In this machine, comprising a closed drum without a casing, not only the discrete batches of laundry but also the discrete washing baths can be separated from one another; clearly, however, there cannot be separate control of the discrete baths and an appropriate supervision of temperature, detergent concentration, additive concentration etc. conditions.

A considerable disadvantage of the machines hereinbefore described is that they cannot be enlarged or reduced by one or more washing areas as may often be desirable for a variety of reasons.

If it is required to have this facility for amplifying the machine and to be able to have accurate separation of the items of laundry and of the baths, plus provision for reducing and maintaining particular conditions in the washing zone, the only solution of the problem is still to use a washing machine of the kind disclosed by German Patent Specification 1,130,403. The machine disclosed thereby does not have a continuous drum but a number of consecutive units completely separated from one another. The laundry is transferred from any washing unit to the washing unit which is adjacent as considered in the direction of conveyance by transfer means which take the form of scoop-like or shovel-like receptacles adapted to pivot around an axis extending transversely of the conveying direction. This machine has proved very satisfactory in practice because of the advantages just referred to, but the transfer of laundry between consecutive washing unit often causes difficulties, for operating difficulties are bound to occur when moving conveyors of the kind described have to deal with an unwieldly material such as wet washing.

SUMMARY OF THE INVENTION

It is an object of the invention to improve the known washing machine, reduce the disadvantages thereof and to provide a washing machine of the kind of interest in the present context wherein there is precise separation or isolation of the discrete washing zones and very reliable conveyance of laundry between consecutive washing zones, so that the novel machine has the advantages of the known series laundry machine and the advantages of the known tubular laundry machine but has the disadvantages of neither. It is more particularly an object of the invention to enable the machine according to the invention to be enlarged or reduced very readily yet to provide a washing machine which, although having such a large number of advantages, is of rugged and reliable construction and of economic price.

According to the invention, therefore, the drum takes the form of discrete cylindrical segments, any two adjacent segments having directly contiguous and faces defined by a partition which extends substantially radially inside the drum the partition being formed with an aperture for the laundry to pass through. Each segment has a conveyor means for transferring the batch of laundry present in the particular segment concerned into the next segment. In order to seal off any two adjacent outer chambers a substantially radial flange extends outwardly from between two adjacent segments of the drum, into a gap between the drum and the casing and a rubbing seal is provided between such flange and the casing. In such a machine the discrete washing zones are therefore completely separated from one another, for not only are chambers or pockets formed in the gap by the flange sealed off from one another but adjacent washing areas inside the drum are completely separated from one another by the partitions, the laundry transfer apertures therein being disposed above the level of the liquid while washing is proceeding.

So that construction is entirely on the unit construction principle, preferably the casing too takes the form of discrete sections or portions which are each allotted to the drum segments, any two adjacent casing portions communicating with one another by way of their end faces. In this case, the end faces are disposed in spaced relationship to one another.

According to another preferred feature of the invention, a casing projection can be provided near the junction between two interconnected casing portions and a drum partition extends into such projection; preferably in this case, a substantially axially extending ring gasket is disposed at the outer edge portion of each partition and cooperates in sealing-tight manner with the two facing inside surfaces of the casing projections. Preferably in this case, a partition has on its outer edge an axially extending flange on whose outside the ring gasket is retained.

For mounting, the drum is preferably supported in an endless retaining element such as flat bands or belts or cables or chains or the like, thus making it unnecessary to have a continuous shaft or stub shafts at the drum ends, a factor which is very important so far as the unit construction idea is concerned.

It has been found that flat belts made, for example, of plastics material and having any plastics material or textile inserts, although theoretically suitable for the work, connot withstand the continuous effect of washing liquid to the extent necessary or at least desirable for lengthy trouble-free operation; the retaining elements rotate at least to some extent in hot washing liquids and may be damaged or distorted etc. More particularly, they may experience different and permanent elongations which cannot readily be compensated for by the available adjustments.

However, according to the invention these disadvantages can be obviated very satisfactorily if the retaining means are flexible steel bands which have been made endless in some appropriate manner. Preferably in this case, an intermediate ring made of plastics material resistant to washing liquid, such as polyamide, is disposed between, on the one hand, a steel band serving as retaining element and, on the other hand, the associated axial flange of the particular partition concerned, the inner surface of such band engaging the outer surface of the intermediate ring. It has been found that these intermediate rings do not give rise to the difficulties associated with retaining elements in the form of flat belts, inter alia because the intermediate rings do not experience tension and so this factor alone obviates the very serious disadvantage of elongation. Also, materials unsuitable for flat belts or the like are available for such intermediate rings; for instance, such a ring can be made of a polyamide, very satisfactory results having been achieved, for example, with a RCG 1000 polyamide.

The intermediate rings preferably have their outer surface formed with a recess which is rectangular in cross-section and in which the steel band is disposed. Peripheral flange-like or collar-like webs therefore arise at the outside edges of the intermediate rings, so that the steel bands cannot run against the casing should they shift axially relative to the intermediate ring. To cope satisfactory with such a shift, which may occur because of unavoidable out-of-round conditions, for example, the width of the groove-like recess in the intermediate ring is greater than the width of the steel band, so that the steel band runs on a running surface which in normal conditions — that is, when the band is running centrally — has clearance on both sides.

Preferably, the axial width of the ring is greater than the width of the axial flanges of the partitions, to ensure adequate clearance between, on the one hand, the edges of the axial flanges and, on the other hand, the machine casing.

Conveniently too, the outer surface of each intermediate ring terminates at a distance from the machine casing, so that there is definitely no chance of the outer surface rising due to unavoidable inaccuracies.

Also, the intermediate rings provide sealing-tightness between adjacent segments, so the ring feature provides good separation or isolation between paths.

To provide a low-cost and reliable kind of drive for a washing machine of this kind without departure from the required unit construction principal, at least one drum-retaining element can cooperate with a drive mechanism. Very conveniently, the particular retaining element concerned or all the retaining elements is or are mounted on shaft which extends axially above the drum. This feature solves not only the mounting problem but also the drive problem. Clearly, a washing machine of this kind can be enlarged fairly readily from, for example, eight washing zones to 10 or 12 washing zones. Very conveniently, a retaining element of this kind, in the form of a flat band for example, extends around the bottom edge of a partition, so that the drum is carried on the partitions. There are two advantages of this feature — first, the retaining elements do not hinder the passage of washing liquid from the gap into the drum, and second the mounting is at the parts of the drum which are strengthened by the partitions, a feature which has advantages with regard to distortions of the drum under load.

In a preferred form of such a machine, the drum is mounted on a number of short axial shafts which are separate from one another and disposed above the drum and whose bearings are borne by the machine casing or by a stationary bearing construction.

This feature fits in very well indeed with the required unit construction principle and has still further advantages. For instance, a failure of any single drive of a short shaft will have little detrimental effect on machine operation since the motors are overdimensioned anyway for different reasons and in such a case can readily provide a correspondingly higher output for a short period.

Preferably, and as is apparent from the foregoing, a short shaft is associated with each segment; advantageously in this case, each short shaft is driven independently. Clearly, therefore, the motor units can be relatively small, with the further advantage that small motors are very easy to position and take up little space.

In a preferred form of such a drive for a short shaft, an electric motor drives vee belting which drives a pulley rotating solidly with the short shafts. In this case a reversing pulley for the particular endless retaining element concerned, preferably a flexible steel band, can be so disposed on the short shafts as to rotate solidly therewith. Very conveniently, each reversing pulley is secured to the hub of the vee-belt pulley which is disposed on the short shaft. The drive can then readily be adapted to a very wide variety of washing conditions and electricity consumption is very low since standard ungeared three-phase motors can be used. This is advantageous since geared motors are relatively costly and require servicing and make considerable noise, which is ergonomically undersirable.

Another advantage of the drive construction just described is that the short shafts are substantially torque-free since the driving torque is, as it were, applied to the shaft externally and does not, as is the case with a continuous shaft, have to be transmitted via the shaft for the whole drum. Consequently, shaft diameters can be smaller and costs are therefore reduced.

For efficient frictional engagement between the reversing pulleys and the steel bands are to ensure very reduced slip, the reversing pulleys preferably having a friction lining on their outside generated surface.

It has been found that a washing machine of this kind, more particularly when it has a large number of segments and is of a corresponding length, forms a structure which cannot of course be inherently rigid. This arises, if for no other reason, from the various assembled-together components, more particularly the consecutive segments etc — and some out-of-roundnesses etc. are unavoidable.

Preferably, to deal with this factor yet to provide a very reliable and long-lived construction, according to the invention the reversing pulleys for the retaining steel bands are each disposed on a substantially horizontal rocker which extends at right angles to the machine longitudinal axis, the rocker being mounted at one end for pivoting around a horizontal axis and having a resilient mounting at its other end. This feature helps to compensate for mis-alignments of various kinds and provides very effective interception and attenuation of impacting caused by the laundry while it is being washed and conveyed. Preferably, the rockers each take the form of two parallel arms between which a reversing pulley is disposed, each arm of a rocker being adjustable vertically, by pivoting around its pivot axis, and horizontally, independently of the other arm.

Preferably, each rocker is mounted resiliently by means of a single spring element on the machine casing or on the machine bearing construction; preferably, the spring element can also act as a damper.

Preferably, the pivot axes and therefore the resilient mounting or bearing positions of adjacent rockers are horizontally offset by 180° from one another so as to provide compensation for the torque loading of the bearing places on the drum. Correspondingly, of course, the driving motors are disposed alternately on opposite sides of the machine.

Preferably, each washing-chamber (segment) conveyor takes the form of an inclinded and sinuously extending chute between a surface of one partition of the chamber and the aperture in the other partition of the chamber. British Patent Specification 516,772 shows an arrangement of this type. In this case, the geometric development of the chute can comprise a part circular portion bounded, for example, by a secant, the distance between the secant and the arcuate portion being less than the radius of the circle; and a triangular portion which joins the circle portion at one corner and which is disposed inside the circle area, one side of the triangular portion being disposed on the secant and being shorter than the same.

A helical chute portion is therefore provided which extends from a surface of one partition of a segment or washing chamber towards the laundry aperture in the other partition of such chamber, the top corner of the sinuously extending chute extending to an edge portion of the laundry aperture concerned, such portion being disposed at the drum surface. The exposed edge of the helical chute portion, such edge not being contiguous with the other partition, communicates with the laundry aperture in the first partition by way of the triangular portion which extends to the helical chute and to the drum longitudinal axis and via which laundry is conveyed for transfer between adjacent washing zones. Preferably, one exposed edge of the triangular portion merges directly with one edge of the laundry aperture, which is preferably a sector of a circle while the other exposed edge of the triangular portion is physically exposed at an inclination to the longitudinal axis or, may, alternatively, merge into another triangular chute portion disposed substantially at right-angles to the first triangular chute portion. Conveniently, the sector angle of such a laundry aperture is less than 180° and is preferably approximately 60°, to leave a large enough aperture for the laundry to pass through and to ensure adequate separation between adjacent washing zones during washing.

To provide the motions necessary both for washing and conveyance, a reversible drive is provided, the conveyor conveniently being disposed at the top of the drum during washing while the drum reciprocates. The drum then makes a single revolution in a direction determined by the conveyor, whereafter reversing washing can be resumed.

Preferably, to achieve intensive washing during washing phases, there is a substantially axially extending rib-like projection on the inside of the segments, on the portion not occupied by the conveyor. It has been found that a single such projection is sufficient to provide an intensive mechanical washing effect.

In cases where the finished laundry is delivered over end, not only does the finished laundry issue from the drum end face right at the bottom of the final drum segment or chamber but there is also an undesirable discharge of water, such discharge occurring even when the drum is not conveying, but just washing or remaining stationary.

Preferably, to obviate this the drum narrows funnel-fashion at its delivery end, that is, the internal diameter of the drum decreases towards the delivery end. A helical conveyor in the form of a deflector is provided in the funnel-shaped terminal portion of the durm and serves to eject the laundry from such portion after washing. This feature provides the required, as it were, abrupt delivery or discharge of a batch of laundry. However there is no appreciable discharge of water since, due to the funnel-shaped construction, the edge portion of the delivery orifice may be, for example, some 300 to 400 mm above the lowest part of the drum chambers in the non-tapering portion of the drum.

Preferably, to ensure a desired and possibly predetermined tensioning of the drum-retaining elements, at least one tensioning element is provided for the retaining elements. Preferably, and more particularly if the retaining element is in the form of a belt or a flat band, the tensioning element can take the form of a tensioning roller or jockey, two oppositely disposed tensioning elements possibly being associated with each retaining element.

According to another preferred feature of the invention, a sensor for operating one or more switches, conveniently electrical contacts, at one or more vertical settings of the drum can be provided at least on a partition near an end part of the machine. The switches can serve to ensure, for instance, that the machine can be started only when it is at a required setting.

Another possibility is that the length of the endless retaining elements is such that when such elements are in the untensioned state, that is, when the machine is not operating, the drum bears on the inside of the casing. No load is therefore applied to the retaining elements unless the machine is in operation and so, inter alia, the working lift of the retaining elements is considerably increased.

BRIEF DESCRIPTION OF THE DRAWINGS

For a better understanding of the present invention and to show how the same may be carried into effect, reference will now be made, by way of example, to the accompanying drawings in which.

DETAILED DESCRIPTION OF THE INVENTION

Figure 1:
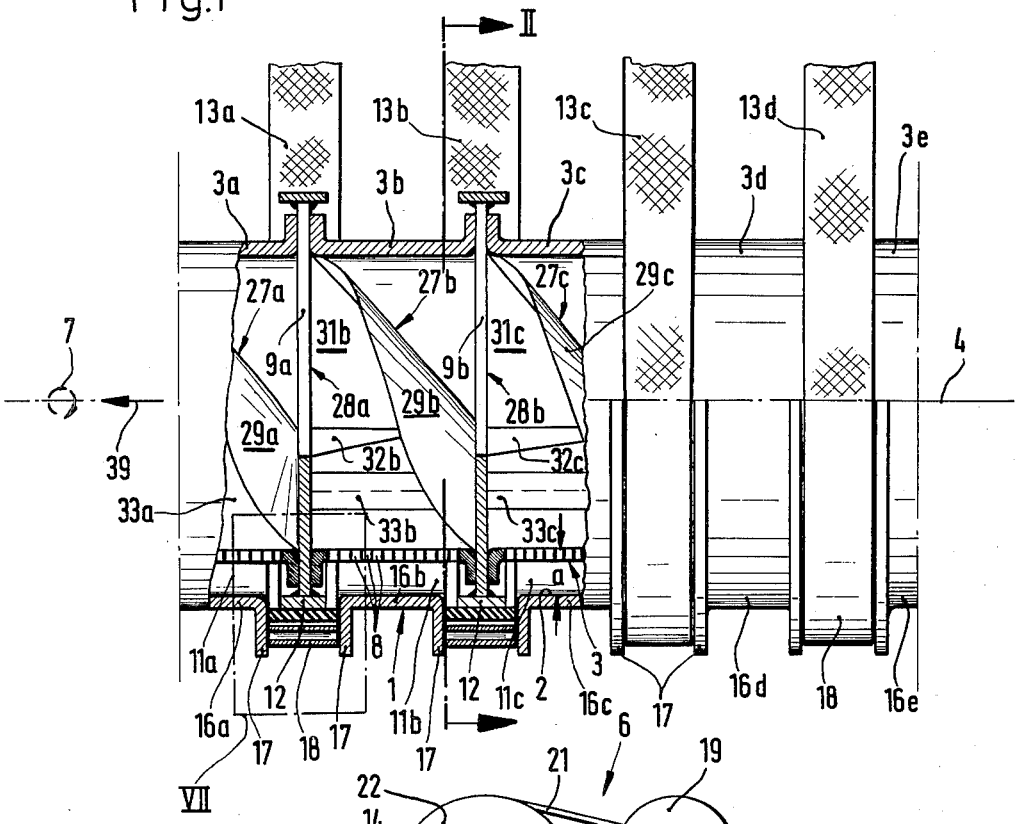
FIG. 1 shows a side elevational view, partly in section and in simplified form, of part of a continuous laundry machine in accordance with the present invention.

FIG. 1 of the drawings show part of a continuous laundry machine for laundering (not shown). For the sake of clarity the drive, the mounting system and the connecting piping between the various washing zones is omitted from FIG. 1.

Figure 2:
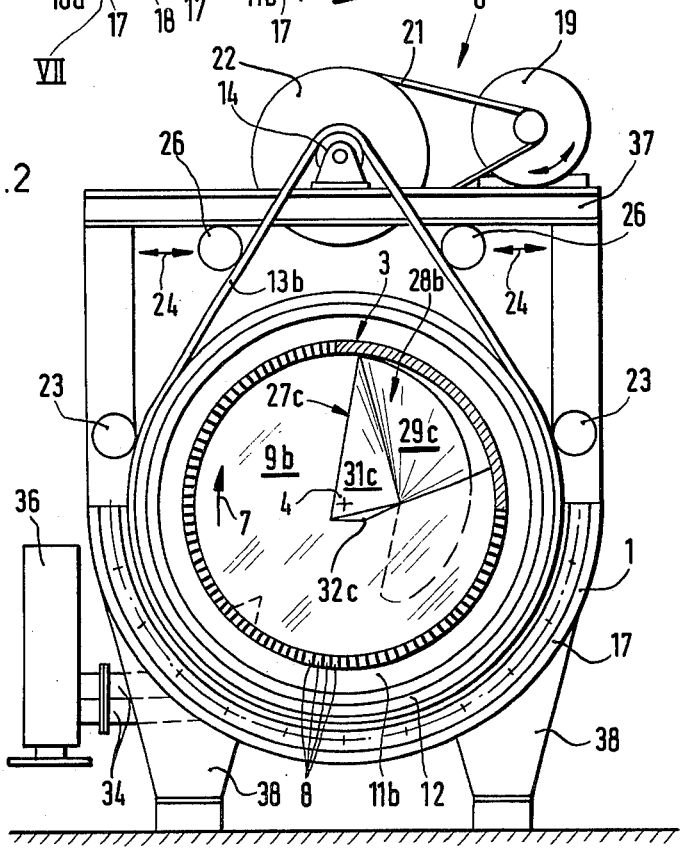
FIG. 2 shows a section through the machine of FIG. 1 on the line II—II.

As can be seen in FIG. 2, the machine has a casing 1 which is, in cross-section, substantially part-circular. A washing drum 3 is disposed at a distance *a* from casing inner wall 2, and a reversible drive 6 can rotate drum 3 about its longitudinal axis 4 in the direction indicated by an arrow 7 (FIG. 2) and in the opposite direction. Approximately 75% of the generated surface of drum 3 is formed with apertures for washing liquid. As will be described in greater detail hereinafter, a conveying facility fixedly mounted inside drum 3 is adapted to move the laundry therethrough in countercurrent to the washing liquid.

The drum 3 comprises a plurality of discrete cylindrical segments, only five — 3*a*, 3*b*, 3*c*, 3*d* and 3*e* — are shown in FIG. 1. Any two adjacent segments, such as 3*a* and 3*b* or 3*b* and 3*c*, are separated by a partition 9. Of the partitions 9, only two partitions 9*a*, 9*b* can be seen in FIG. 1 and only the partition 9*b* can be seen in FIG. 2. Each segment 3*a* to 3*e* has its own conveying facility which will be described in greater detail hereinafter.

The gap between the casing inner wall 2 and the outside of the drum 3 is subdivided radially into chambers 11*a*, 11*b*, 11*c* and so on which are substantially completely sealed off from one another. To this end, the partitions 9*a*, 9*b* each extend radially beyond the segments 3*a* to 'e. At their outer edge the partitions 9*a*, 9*b* have an axially extending flange 12. A flat belt 13*a*, 13*b*, 13*c*, 13*d* engages with the radially outer surface of the flanges 12 and extends upwardly from the particular flange concerned, as can be seen in FIG. 2, to engage with a drive shaft 14 at the top of the machine. The belts 13*a* to 13*d* are endless.

As can be gathered from FIG. 1, the casing 1 is combined from discrete portions 16*a* to 16*e* which are associated with the corresponding drum segments or washing chambers 3*a* to 3*e*. Any two adjacent portions, such as 16*a* and 16*b* or 16*b* and 16*c* and so on are interconnected by way of adjacent flange portions 17. The flange portions 17 are spaced apart by spacers 18 in the form of curved flat metal members which have a sealing composition on the edges thereof adjacent the surfaces of the flange portions 17. The flange portions provide a casing projection near the junction between any two interconnected casing portions 16*a*, 16*b* or 16*b*, 16*c* and so on, and as FIG. 1 shows, a respective partition 9*a*, 9*b* etc. of drum 3 extends into such projection. Sealing-tightness between any two adjacent outer chambers 11*a*, 11*b* or 11*b*, 11*c* and so on is achieved by means of the belts 13*a* to 13*d* which engage with the flanges 12 of the partitions 9. The edges of the belts 13*a* to 13*d* each cooperate to provide sealing tightness with the two facing inner surfaces of a casing projection that is, with those faces of the flange portions 17 which are adjacent one another, to provide a sliding or rubbing seal.

As well as providing sealing tightness between adjacent chambers 11*a*, 11*b* or 11*b*, 11*c* etc. the belts 13*a* to 13*d* also serve for the mounting of the drum 3 and participate in the drive thereof, as will be described in greater detail hereinafter with reference to FIG. 2.

For the drive of the drum 3, an electric motor 19 drives, via a vee-belt 21 and a pulley 22, the drive shaft 14 with which the belts 13*a* to 13*d* are in frictional engagement. As can be seen in FIG. 2, rollers 23 keep the belts 13*a* to 13*d* in engagement with the flanges 12 of the partitions 9. Also, rollers 26 movable in the direction of the arrows 24 engage the outside of the belts 13*a* to 13*d*, so that it is a simple matter to align the drum 3.

Each drum segment or chamber 3*a* to 3*e* has a respective conveying facility 27*a*, 27*b*, 27*c* and so on extending from a closed part of one partition, such as 9*b*, to a laundry aperture 28*a*, in the partition 9*a*, of a segment 3*b*. Basically, the conveyors 27*a*, 27*b* and 27*c* take the form of inclined sinuously extending chutes. The chutes are each produced from a sheet of material taking the form of a segment of a circular disc. The main portion of each chute is formed by bending the segments to form helical portions 29*a*, 29*b*, 29*c* etc. which are fitted in corresponding chambers or segment 3*a* to 3*e*. The sheets of material from which the chutes are produced also each comprise a triangular portion one side of which is defined by only part of the length of the chord of the segment. The triangular portion is disposed within a circle which would be formed by a continuation of the arc of the segment. After assembly the triangular portion forms an inclinded chute 31*b* or 31*c*, as will be apparent from a consideration of FIGS.

1 and 2. The chutes 31*b*, 31*c* are disposed in the respective chambers or segments of the drum 3 at an inclination to the longitudinal axis and one edge of the chute (formed by an edge of the triangular portion) merges with the non-partition-contacting edge of a corresponding helical portion 29*a*, 29*b* 29*c* etc. Another edge of the triangular portion 31*b*, 31*c* meets an edge of a corresponding laundry aperture 28*a*, 28*b* whilst the other edge of the triangular portions 31*b*, 31*c* join onto another triangular portion 32*b*, 32*c* which extends substantially perpendicularly to the first triangular portion 31*b*, 31*c* in the particular drum segment concerned.

The laundry apertures 28*a*, 28*b* substantially resemble sectors of circles and have a sector angle of approximately 60°, as can be seen from FIG. 2.

A substantially axially extending rib 33*a* 33*b*, 33*c* is disposed on that portion of the inside of the drum segments 3*a* to 3*e* which is not occupied by the conveyor 27*a*, 27*b*, 27*c*.

As shown in FIG. 2, pipes 34 are connected to the outer chambers 11*a*, 11*b*, 11*c* and, liquid control boxes 36 are provided at the free ends of the pipes 34.

As shown in FIG. 2, the drive 6 and the drive shaft 14 are mounted on a frame 37 which extends down to the stationary part of the machine, that is, to the casing 1. The casing 1 has legs 38 for supporting it on the foundation.

Figure 3:
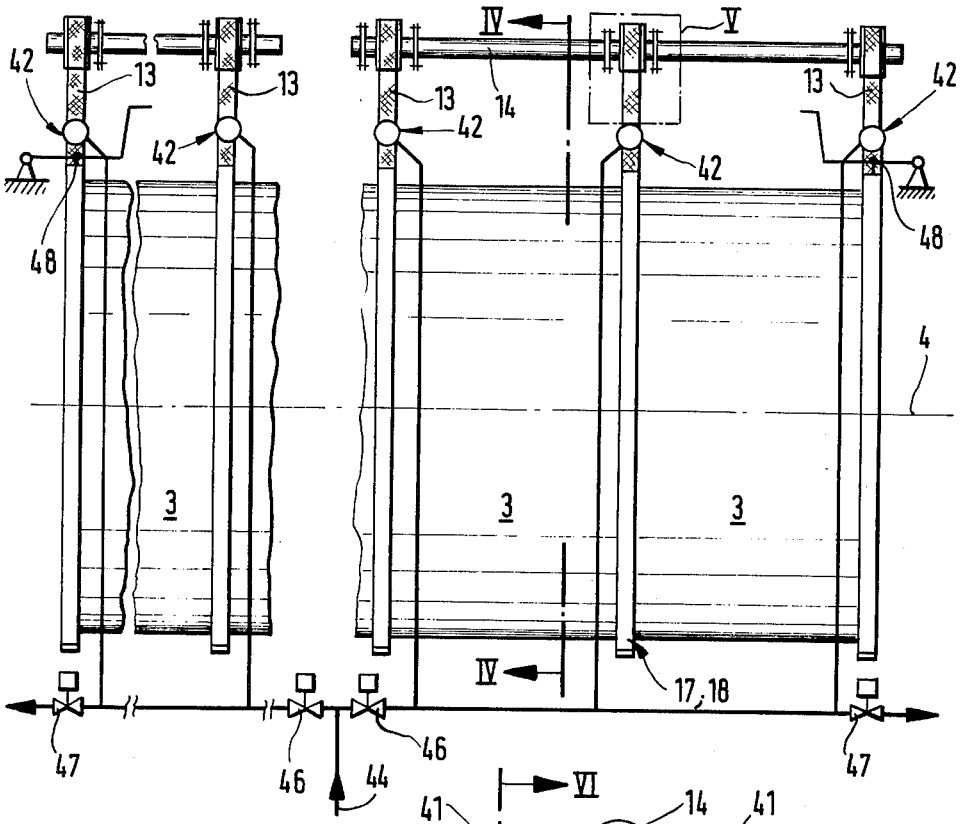
FIG. 3 shows a diagrammatic view in side elevation of part of the drum and of drive shaft and of the piping supplying air to the reciprocating actuators for the tensioning elements.
Figure 4:
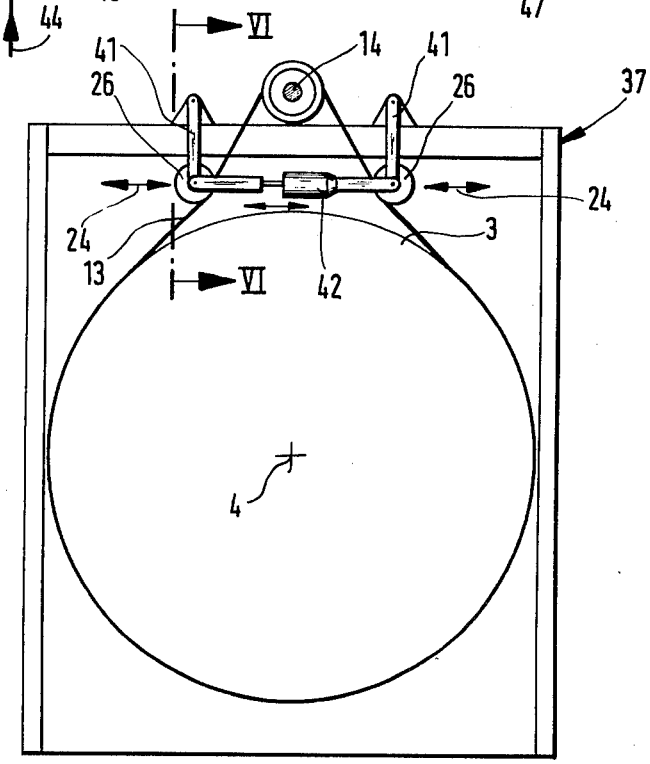
FIG. 4 shows a view corresponding to FIG. 2, in highly diagrammatic form, in section on the line IV—IV of FIG. 3.

FIGS. 3 and 4 are very diagrammatic side elevational views of the washing machine, more particularly of the casing, with the ommission of a large number of items and with particular emphasis on the drum 3 and the drive shaft 14. As can be gathered from FIG. 4, the retaining elements 13, which take the form of flat belts, are each associated with two tensioning elements in the form of jockeys 26 (also diagrammatically indicated in FIG. 2). The jockeys 26 are disposed opposite one another. They are suspended on a cross-member of the frame 37 by means of link suspensions 41 and the two rollers of each pair are interconnected by a reciprocating actuator 42, the devices 42 being pneumatically operated and being described in greater detail hereinafter.

Figure 6:
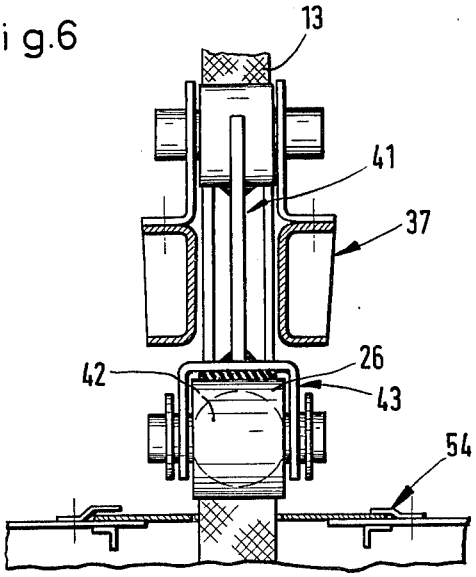
FIG. 6 shows a view to an enlarged scale, in section on the line VI—VI of FIG. 4, of a link support for suspension of the tensioning elements.

As shown in FIG. 6, the bottom end portion of the link suspensions 41 which retains the jockeys 26 takes the form of a clevis 43. So that the belts 13 can move past the jockeys 26 and the actuators 42 in the manner shown in FIG. 4 (and FIG. 2), the actuators 42 are each connected to the associated clevis 43 in the manner shown in FIG. 6.

As can be seen in FIG. 3, a number of actuators 42 are connected to a common pressure source, symbolized in FIG. 3 by an arrow 44, half of all the actuators 42 being combined to form a first group so far as pressure medium supply is concerned, each of the two actuator groups which are visible in FIG. 3 having an inlet valve 46 and an outlet valve 47 for the pressure medium.

Disposed on each of the partitions 9 is a sensor 48 adapted to operate a number of electrical contacts at adjustable vertical settings of the drum 3.

The length of the belts 13 is such that, when they are not in tension, the drum 3 bears on the casing inside 2, so that there is no load on the belts 13 when the machine is inoperative.

Figure 5:
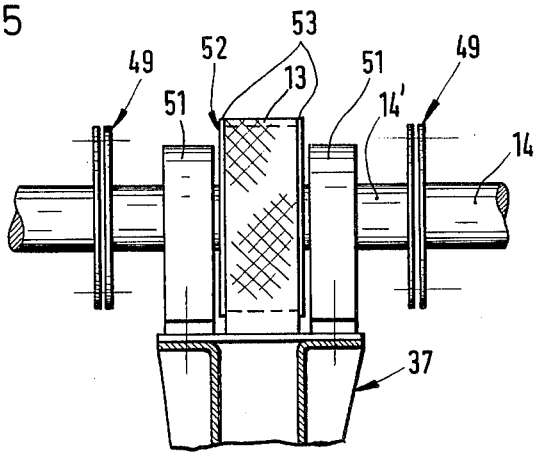
FIG. 5 shows a view to an enlarged scale of details of the zone V disposed inside chain-dotted framing in FIG. 3, the zone V representing a drive shaft mounting or bearing zone.

FIG. 5 shows a bearing zone of shaft 14, supplementing the diagrammatic view of FIG. 3. The drive shaft 14 consists of portions interconnected by flange couplings 49. Correspondingly, the portion 14′ visible in FIG. 5 has part of a coupling at each of its two ends and is mounted in two bearings 51 carried on a cross-member of the frame 37. A guide roller 52 rigidly connected to the portion 14′ the shaft 14 is disposed between the two bearings 51 and has at its two lateral boundary surfaces edges 53 to ensure positive guidance of the belts 13 on the roller 52.

The lower part of FIG. 6 shows a cover 54 for the casing 1, the cover 54 preventing vapours, sprayed liquid and the like, from discharging upwardly or to the outside. As will be apparent, the belt 13 extends through the cover 54, then engages with drum 3 in the manner shown in FIGS. 2 and 4.

Figure 7:
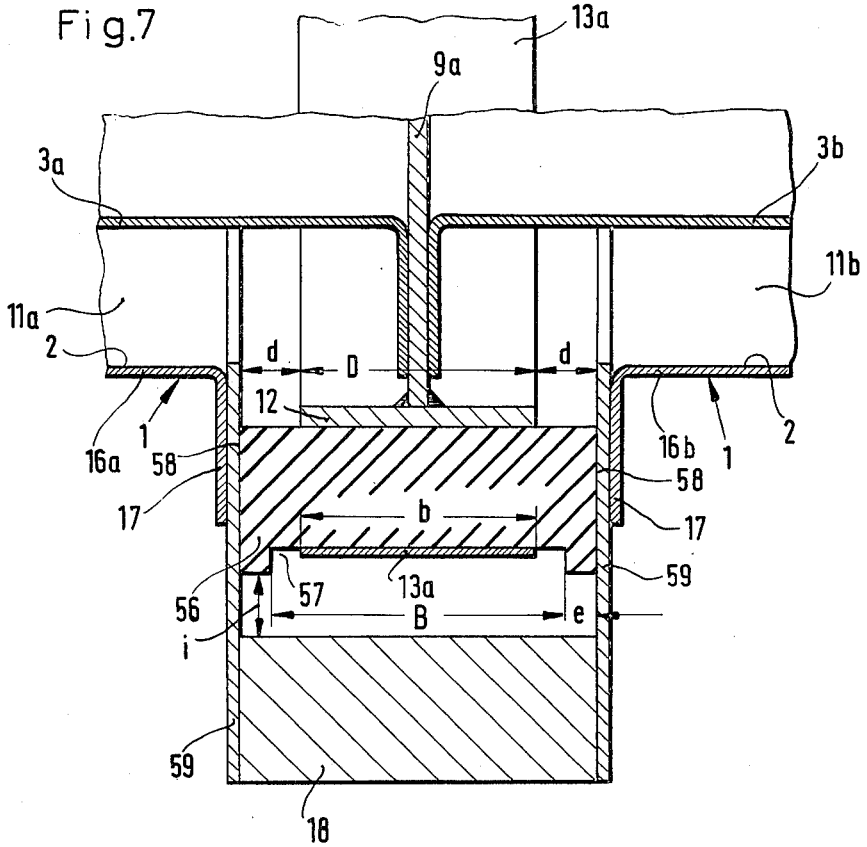
FIG. 7 shows a view to an enlarged scale of an alternative form of the portion III framed by chain-dotted lines in FIG. 1.

In FIG. 7, which shows the part of the machine framed in chain-dotted lines in FIG. 1, the belts 13 take the form of flexible steel bands, an intermediate ring 56 being disposed between each steel band 13 and the associated axial flange 12, the ring 56 being made of a plastics material resistant to laundry liquids, such as a RCH 1000 type polyamide. The inner surface of the steel band 13*a* engages with the outer surface of the ring 56.

The ring 56 is formed on its outer surface with a rectangular cross-section groove-like recess 57 which is adapted to receive the band 13*a*, the width B of the recess being greater than the width *b* of the band 13. Also, the overall axial width $B + 2e$ of ring 56 is greater than the width D of the flange 12, with the result that there are clearances *d* between the casing 1 and the flange 12; consequently, even if the partition 9*a* experience impacting because of unavoidable production inaccuracies, misalignments, sagging or the like, it cannot contact the casing 1. For the same reason the outer surface of the ring 56 terminates at a distance *i* from the casing 1 or from the spacer 18 rigidly secured thereto, thus obviating the risk of grazing.

The machine is devised correspondingly so far as the partitions 9*b*, 9*c* and so on are concerned.

The bands 13 are made of non-rusting steel. They are very advantageous, since the washing liquid does not attack them and they experience virtually zero elongation as a result of the weight of the drum 3 and its contents. In cooperation with the associated ring 56, the result is not only excellent suspension of the drum 3 but also a sealing of the washing baths on both sides, since there can be no appreciable exchange of liquids through the gaps 58 between the ring 56 and the portion 59 forming part of the casing 1.

This feature also satisfies the requirements for steel construction since, for example, the drum partitions 9 may readily suffer from misalignments without causing disturbances in operation or even damage to the machine. The bands 13 have limited provision for axial reciprocation, for example, because of different loading conditions of the drum, without any risk of disturbances arising.

Figure 9:
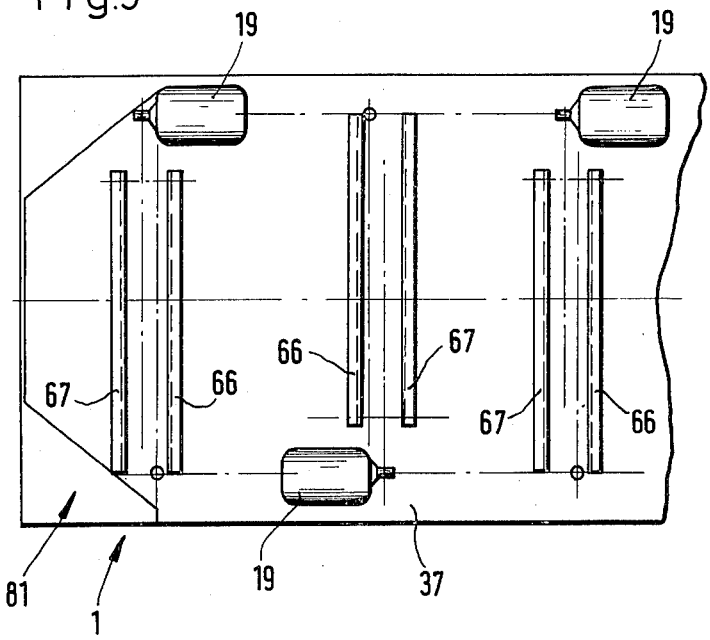
FIG. 9 shows a diagrammatic simplified plan view of the front end portion of the machine part of which is shown in FIG. 8, in simplified form.
Figure 10:
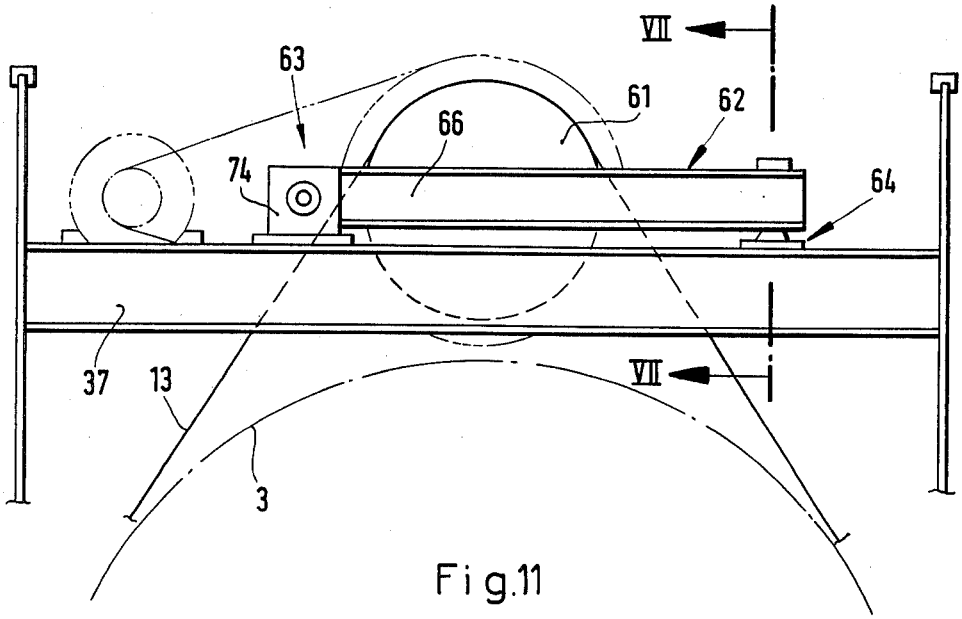
FIG. 10 shows a transverse sectional view, in diagrammatic form, of part of the machine of FIG. 8, the drum segments or chambers being mounted on rockers as in the construction shown in FIG. 5.

FIGS. 8 to 11 shows part of a machine having a different drive mechanism. FIG. 10 is a simplified view of the drive mechanism corresponding to the top part of FIG. 2 but with many items omitted, since it is the mounting which will be particularly described with reference to FIG. 10. As shown in FIG. 10, the belts 13 indicated merely by a chain-dotted line in FIG. 10, are flexible steel bands 13 which reverse over a respective pulley 61 disposed above the drum 3. Each pulley 61 is secured to a substantially horizontally extending rocker 62 which is disposed at right-angles to the drum longitudinal axis and whose construction is basically apparent from FIG. 11. The rocker 62 of each drive unit is pivotally mounted at one end 63 on the frame 37 and can therefore pivot horizontally. At its other end 64 the rocker 62 is resiliently mounted.

Figure 11:
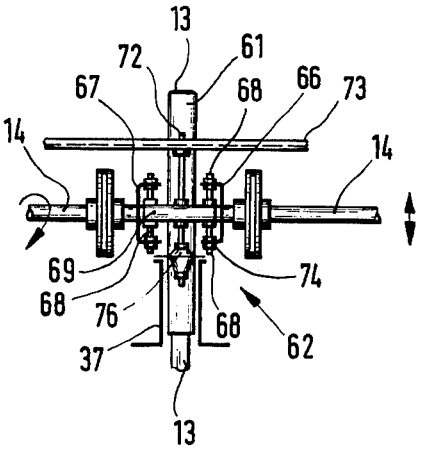
FIG. 11 shows a sectional view on the line VII—VII of the part shown in FIG. 10.

As shown in FIG. 11, each rocker 62 mainly comprises two parallel arms 66, 67 between which the associated reversing pulley 61 is disposed. Each arm 66, 67 of each rocker 62 is vertically and horizontally adjustable independently of the other arm 67, 66. To this end, adjusting screws 68 provided in the end portion 64 of each rocker 62 enable the pivoted position of the particular rocker arm 66 or 67 concerned to be adjusted relatively to a cross-member 69. The screws 68 are then locked by nuts 71. This feature provides very satisfactory adjustment of true running of the drive elements to be described hereinafter. Each cross-member 69 is secured by screws 72 to a connecting section member 73, the same therefore interconnecting all the mounting or bearing positions and providing adequate stability for the complete system and precluding simultaneous different vertical deflections.

Horizontal adjustment can be provided by appropriate adjustment of the associated bearing 74 for the rocker arm concerned on the frame construction 37; FIG. 10 only shows the bearing for the arm 66. The resilient mounting for each rocker 62 takes the form of a single resilient and damping element 76 which bears on the frame 37 and which may be, for exmple, a metal-to-rubber bonded device.

Figure 8:
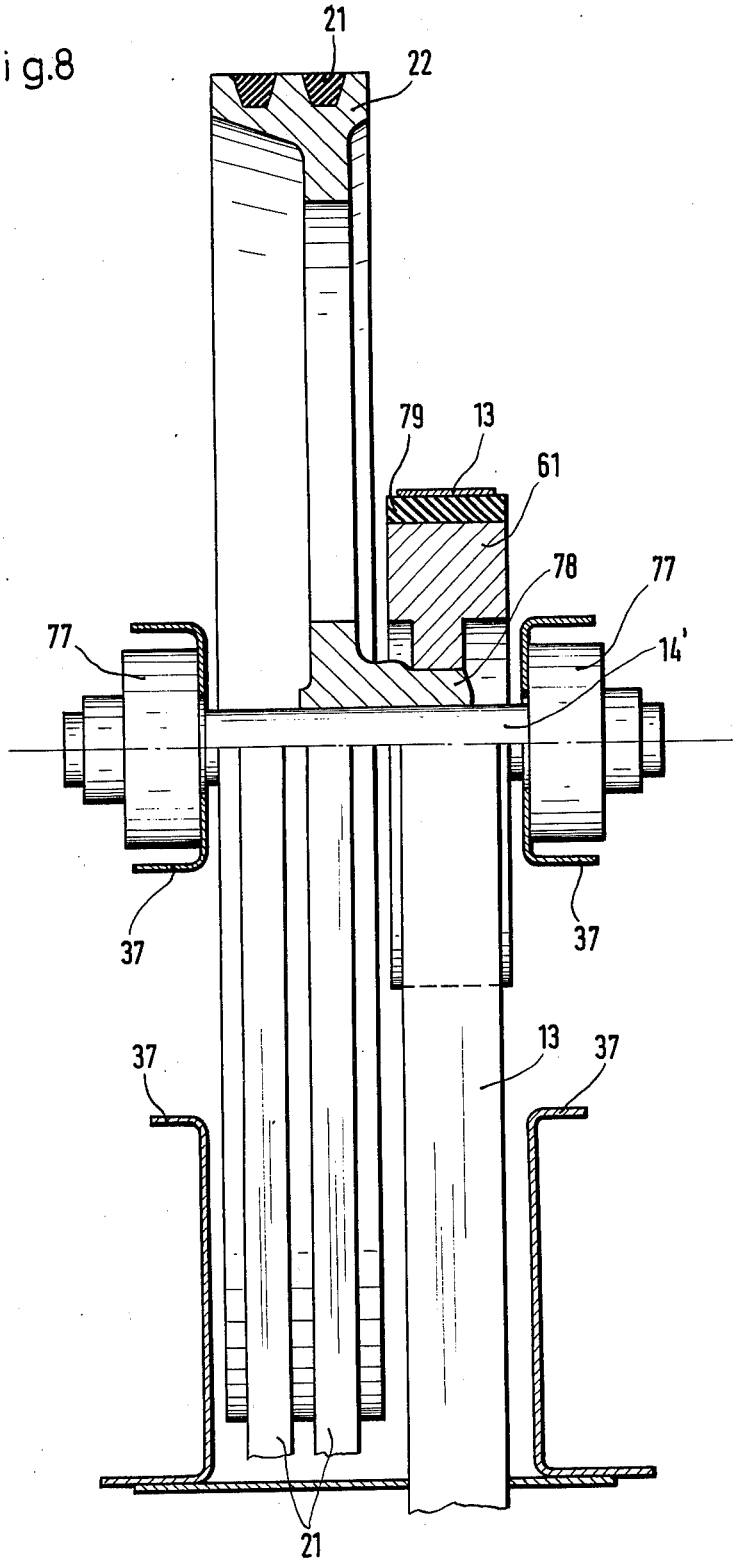
FIG. 8 shows a simplified view, partly in longitudinal section, of part of a drive mechanism of another machine in accordance with the present invention.

The drive mechanism shown purely in diagrammatic form in FIG. 10 is dash-triple-dotted lines, will now be described in greater detail with reference to FIGS. 8 and 9. Drum 3 is suspended on a number of short shafts 14' whose bearings 77 are carried on the frame 37. The shafts 14' serve not only for the mounting or suspension of the drum 3 but also for the drive of the machine, as will be described hereinafter.

Each drum segment or chamber 3*a* to 3*e* has one such short shaft 14' associated with it, each such short shaft being driven independently.

Each shaft 14' is driven by an independent electric motor 19 by way of vee-belting 21 and a pulley 22 (see FIG. 8) secured to shaft 14' so as to rotate therewith. Also similarly secured to each shaft 14' is the associated reversing pulley 61 for the associated steel band or the like 13, each reversing pulley 61 being secured to the hub 78 of the belt pulley 72 as can be seen in FIG. 8. The outer surfaces of the pulleys 61 have a friction lining 79 to ensure a satisfactory frictional engagement between the pulley 61 and the steel band 13.

As can be gathered from the very simplified view given in FIG. 9 which is a diagrammatic plan view of the front portion of the machine, the motors 19 are disposed in alternate relationship on either side of the construction 37, and so the rockers 62 are each horizontally offset by 180° with respect to one another, so that the pivot axes at the rocker ends 63 and the resilient elements 66 at the rocker ends 64 are correspondingly each alternately offset from one another by 180°.

The arrangement which has been described with reference to FIGS. 8 to 11 provides outstandingly quiet operation even for prolonged periods despite the steel construction and the large number of interconnected and in some cases moving parts, since the arrangement permits excellent settings and adjustments being made while the complete apparatus is being run-in. Also, electricity consumption is very low since the motors 19 are simple and rugged three-phase motors and since they cooperate with belt drives, that is, no geared motors or the like are used. Also, failure of a single motor does not entail stoppage of the complete apparatus, which can continue to run at least until termination of the washing programme. Also, the driving forces are applied in such a way that the diameter of the shafts 14' can be much less than if a single continuous shaft were to be used.

Basically, however, and as shown in FIG. 11, a continuous shaft can be used. Conveniently, in this case, universal shafts (not shown so as not to overload the drawings) are provided for the individual portions of the shaft 14.

Figure 12:
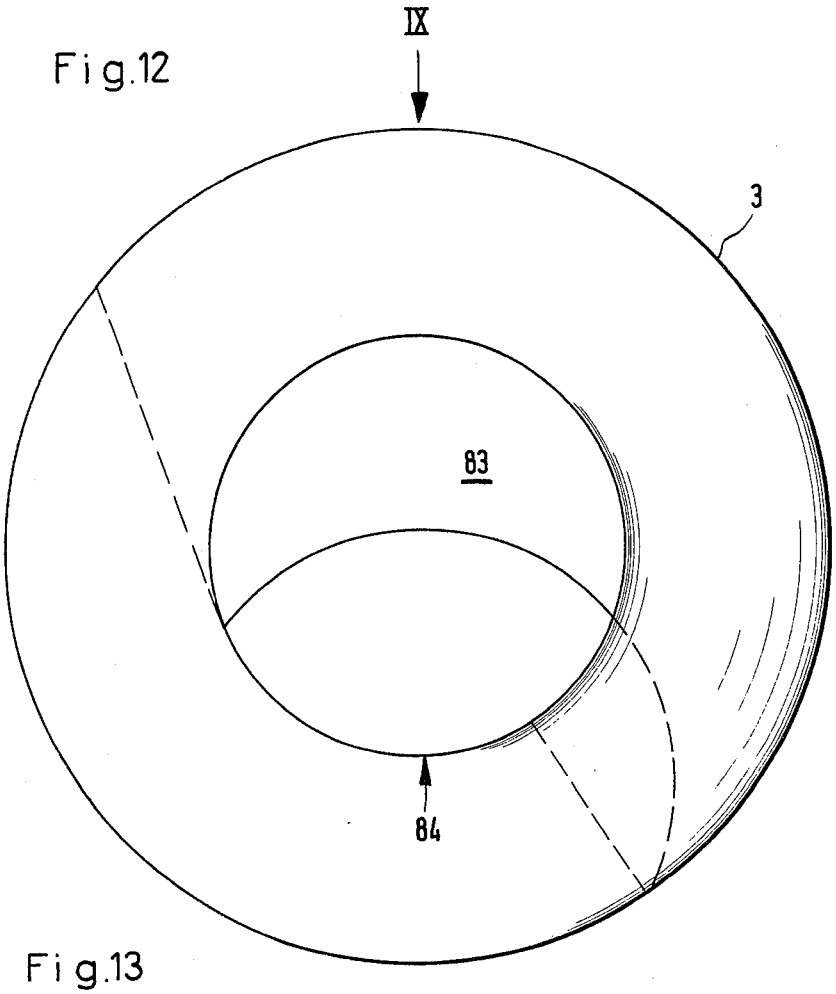
FIG. 12 shows a simplified front elevational view, looking in the direction of the arrow VIII of FIG. 13 of the delivery end of the washing machine part of which is shown in FIG. 8.
Figure 13:
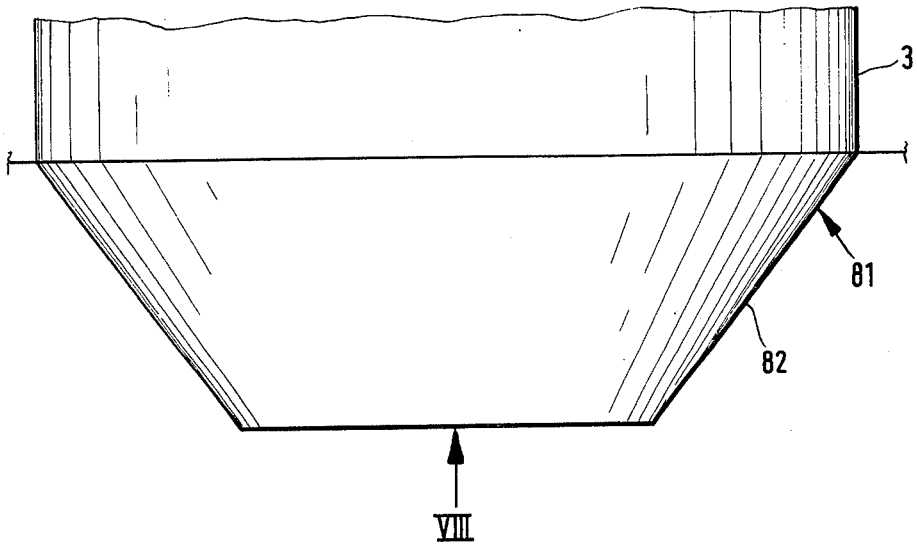
FIG. 13 shows a simplified and diagrammatic plane view of the front end portion of the drum shown in FIG. 8, looking in the direction of the arrow IX of FIG. 12.

FIGS. 12 and 13 show simplified views of the discharge or exit and 81 (see FIG. 9) of the machine, the drum 3 narrowing funnel-fashion at its delivery or discharge end. The funnel-shaped portion 82 of the machine has a helical conveyor 83 (not shown in FIG. 13 so as not to overload the drawing). The batches of laundry which have been washed are delivered by the conveyor 83, as it were abruptly, from the drum portion 82 but without any apreciable discharge of washing liquid, since the level of the washing bath is lower than the lowest point 84 of the funnel-shaped portion 82.

The operation of the machine will now be described.

Laundry for washing is introduced, by means of a feeder (not shown), into a first segment or chamber of the drum 3; the first segment is not shown in FIG. 1 and is disposed at the right-hand end of the drum 3. The first segment can be used, for example, for soaking. Washing is then given by reversing rotary or pivoting movements around the drum axis 4, the angle of rotation or pivoting being less than 360°.

After a predetermined time or after a number of reversing rotary movements corresponding to a predetermined time, the drum 3 makes one complete revolution in the direction indicated by the arrow 7, the angle of rotation being more than 360°. The laundry batch concerned, just like the laundry batches disposed in the other segments or chambers 3*a* to 3*e* reaches the inside of the helical portion 29*a*, 29*b*, 29*c* of the corresponding conveying facility 27*a*, 27*b*, 27*c* and is conveyed onwards by sliding on the helical portion 29*a*, 29*b*, 29*c* in the direction indicated by the arrow 39, the laundry passing onto the chute portion defined by the triangular portion 31*b*, 31*c*, thereof and then passing therefrom through the laundry aperture 28*a*, 28*b* in the respective partition 9*a*, 9*b* onto whichever segment is the next as considered in the direction of the arrow 39.

The next segment can, for instance, still form part of the soaking zone or from part of the prewash zone. This segment can the be followed by, for example, multi-segment washing zone for the main hot wash, which can be followed by another zone for hot rinsing and finally a cold rinse zone.

Depending upon circumstances and requirements, any particular zone can be omitted or an extra segment can be added to any particular zone or a segment removed therefrom. Consequently, a washing programme using five washing zones may, for example, be carried out in a machine the drum of which has a total of from 5 to 12 segments and a corresponding number 16*a* to 16*e* of casing portions.

As will be apparent from the foregoing description and from the drawings, each of the discrete outer chambers 11*a*, 11*b*, 11*c* is completely sealed off from the others, thus making it possible to specify and maintain very accurately the conditions in each washing zone without the interchange conditions in the border regions extending as far as the central part of any wasing zone. For instance, a temperature of 70° C can be maintained very accurately in one washing zone, whereas in the next zone the temperature can be 90° C. Similarly, washing conditions in respect of the addition of detergents and additives can be maintained within very defined conditions in the machine according to the invention. The complete laundering operation can therefore be kept under much better control than it can be with known washing machines, with the final result of better laundering.

The washing ribs 33*a*, 33*b*, 33*c*, by their mechanical washing effect, provide a very effective contribution to the washing action. It has been found that just a single rib 33*a*, 33*b*, 33*c* is sufficient to produce an excellent result.

Also, during the reversing washing movement the drum 3 is in such a position that the conveying facilities 27*a*, 27*b*, 27*c* are mainly uppermost, the rotating of pivoting movement occurring around this position.

The provision of jockeys 26, reciprocating actuators 42 and sensors 48 makes it possible, so far as the starting, operation and run-out of the machine described more particularly with reference to FIGS. 1 and 6 are concerned to provide the following cycle of operations:

When the machine is inoperative, no compressed air is supplied from the source (arrow 44 in FIG. 3) and so there is no pressure in the air line and actuators 42. The drum 3 is borne by the casing 1 and does not load the retaining elements 13.

At switch-on the two air inlet valves 46 are operated electrically, with the result that compressed air is supplied uniformly to all the pistons of the actuators 42. Drum 3 is therefore raised, because of the restriction caused by the jockeys 26, until reaching its operative position. The sensors 48 are operated in the operative position. Only after the sensors 48 have been operated is the drive 6 for the drive shaft 14 and therefore for starting actual laundering operative. Simultaneously, the inlet valves 46 close automatically. Consequently, the drum 3 is disposed, when it starts to be driven, in a horizontal position, the tension of all the belts 13 being substantially identical.

To alter the relative height of the drum 3 with respect to the casing 1 because of impressed forces or pulses which arise in laundering, more particularly because of laundry dropping off the rib 33, a minimum-maximum-control (not shown) which does not form part of the invention is provided.

For instance, if the initially empty drum 3 drops as it is loaded, due to the belts 13 stretching, to a level below the required operating position, contacts operated by the sensors 48 open either one or both inlet valves 46 until the drum 3 has been restored to its operative position. The converse occurs when the drum 3 is emptied slowly. Slow emptying might of course lead to the drum 3 rising excessively, and in this case when the required permissible maximum height is exceeded one or both outlet valves 48 open so that the drum 3 sinks until it has been restored to the required operating position.

The outlet valves 47 are operated when the machine is stopped so that the drum 3 drops into the inoperative position previously described.

Clearly, the operation hereinbefore described ensures automatic alignment of the machine over a wide variety of loadings, and the fact that the belts 13 are loaded uniformly and have no load on them when the machine is inoperative ensures that they have a long working life. Also, the automatic height control, which is operative not only at start-up but throughout laundering, provides a damping effect which has advantages so far as the transfer of dynamic bearing forces to the surrounds is concerned. Yet another advantage is that the construction of the suspension and of the tensioning means can provide considerable compensation for mis-alignments of the partitions which cooperate with the endless belts.

The machine according to the invention, as well as being reliable in operation, rugged, of simple construction and therefore of economic cost, offers more particularly and readily the possibility of enlarging or reducing the casing 1 by one or more segments 3*a* to 3*e* and portions 16*a* to 16*e* and so this unit construction feature always ensures optimum adaptation to individual circumstances.

We claim:

1. A laundry machine which comprises a washing drum having a longitudinal axis and a generated surface, said drum being rotatable about said longitudinal axis, said generated surface of the drum being formed with apertures through which washing liquid can flow, a casing having an inner surface portion which is spaced apart from an outer surface of the drum to define a gap therebetween, at least one partition which extends substantially radially inside the drum thereby dividing the drum into discrete segments, any two adjacent segments having contiguous end faces defined by a respective partition formed with an aperture, conveyor means disposed inside the drum for conveying laundry from one segment of the drum to an adjacent segment thereof via the aperture in the respective partition, a flange which extends substantially radially outwardly from the respective partition, and from between each pair of adjacent segments thereof, and each partition having a flange portion extending substantially axially of the drum, said casing comprising discrete casing sections corresponding to respective drum segments, any two adjacent casing sections being interconnected at end faces thereof facing each other but being spaced from each other, the casing having projecting portions at adjacent casing sections, said flange portions extending into the respective projecting portion, thereby dividing said gap between the drum and the casing into chambers, means providing a fluid-tight seal between each flange portion and the adjacent casing projecting portions and including a sealing member in frictional contact with the radially outer surface of said flange portion, and means for supplying washing liquid to each chamber.

2. A laundry machine which comprises a washing drum having a longitudinal axis and a generated surface, said drum being rotatable about said longitudinal axis, said generated surface of the drum being formed with apertures through which washing liquid can flow, a casing having an inner surface portion which is spaced apart from an outer surface of the drum to define a gap therebetween, at least one partition which extends substantially radially inside the drum thereby dividing the drum into discrete segments, any two adjacent segments having contiguous end faces defined by a respective partition formed with an aperture, conveyor means disposed inside the drum for conveying laundry from one segment of the drum to an adjacent segment thereof via the aperture in the respective partition, a flange which extends substantially radially outwardly from the respective partition, and from between each pair of adjacent segments thereof, and each partition having a flange portion extending substantially axially of the drum thereby dividing said gap between the drum and the casing into chambers, means providing a fluid-tight seal between each flange and the casing, and at least one endless retaining element comprising a flexible steel belt which is arranged to support the drum, and an intermediate ring made of a plastics material, such as polyamide, resistant to washing liquid disposed between said steel band and said flange portion, an inner surface of said band engaging an outer surface of said intermediate ring.

3. A machine according to claim 2, wherein the outer surface of the intermediate ring has a recess which is rectangular and of a predetermined width, in cross-section, and in which the steel band is received.

4. A machine according to claim 3, wherein said width of the recess is greater than the width of the steel band in said recess.

5. The machine according to claim 2, wherein the axial width of the ring is greater than the width of the axial flange portion in axial direction of said drum.

6. A machine according to claim 2, wherein the outer surface of the intermediate ring is spaced from a part of the casing in a direction radially of the drum.

7. A machine according to claim 2, wherein the retaining element extends around a radially outer portion of said flange.

8. A machine according to claim 2, comprising a reversible drive mechansim with a plurality of individual relatively short shafts disposed above the drum and extending substantially parallel to said longitudinal axis, a frame rigidly connected to said casing, said retaining element cooperating with said drive mechanism and being mounted on one of said shafts.

9. A machine according to claim 8, wherein one each of said shafts is associated with each segment of the drum.

10. A machine according to claim 8, wherein each short shaft is driven independently.

11. A machine according to claim 10, wherein said drive mechanism further comprises an electric motor, a plurality of drive pulleys respectively mounted on said shafts for rotation therewith, a plurality of V-belts respectively passed over said pulleys and driven by said motor, and a reversing pulley mounted for rotation with a respective short shaft and around which pulley passes a respective endless retaining element.

12. A machine according to claim 11, wherein each drive pulley has a hub, the respective reversing pulley being mounted on the respective hub.

13. A machine according to claim 11, wherein each reversing pulley has a friction lining on its outer surface.

14. A machine according to claim 11, wherein the retaining element passes around a respective reversing pulley which is disposed above the drum and which is disposed on a substantially horizontal rocker which extends at right-angles to the longitudinal axis of the drum, the rocker being mounted at one end for pivoting about a horizontal axis and having a resilient mounting at its other end.

15. A machine according to claim 14, wherein two adjacent ones of said rockers including respective drive mechanisms are horizontally offset at a 180° from one another.

16. A machine according to claim 14, wherein the rocker comprises two parallel arms between which the reversing pulley is disposed, each arm of the rocker being vertically adjustable independently of the other arm.

17. A machine according to claim 16, wherein each arm of the rocker is horizontally adjustable independently of the other arm.

18. A machine according to claim 16, wherein the arms of the rocker are carried on a common cross-member.

19. A machine according to claim 18, wherein the machine comprises a plurality of said rockers and wherein each cross-member is interconnected by means of a section-member.

20. A machine according to claim 14, wherein each rocker bears by way of a single spring element on the machine casing via the frame of the machine.

21. A machine according to claim 1, wherein the conveyor means comprises, in each segment of the drum, an inclined and sinuous chute which extends between a surface of one of said partitions of one segment and the aperture in the other partition of the same segment.

22. A machine according to claim 21, wherein the chute is a sheet of material comprising a segment of a circular disc, and a triangular portion one side of which is defined by only part of the length of the chord of the segment, the triangular portion being disposed within a circle which would be formed by a continuation of the arc of the segment.

23. A machine according to claim 1, wherein each of the apertures in the partitions are substantially sectors of a circle, the sector angle being less than 180°.

24. A machine according to claim 23, wherein the sector angle is approximately 60°.

25. A machine according to claim 1, wherein there is a substantially axially extending rib-like projection on part of the inner surface of each segment of the drum, which part is not occupied by the conveyor means.

26. A machine according to claim 1, wherein a sensor for operating one or more switches at one or more vertical settings of the drum is provided at least on a partition adjacent one end of the machine.

27. A machine according to claim 2, wherein at least on tensioning element is provided for the retaining element.

28. A machine according to claim 2, wherein the length of the endless retaining elements is such that the drum bears on the inner surface of the casing.

29. A machine according to claim 2, wherein the drum has a loading end and a discharge end and narrows funnel-wise towards its discharge end.

30. A machine according to claim 29, wherein a helical conveyor is disposed in the funnel-shaped end portion of the drum and serves to eject batches of laundry from such end portion after laundering.

* * * * *